US007311071B2

(12) United States Patent
Yamanaka

(10) Patent No.: US 7,311,071 B2
(45) Date of Patent: Dec. 25, 2007

(54) VARIABLE VALVE TIMING CONTROL APPARATUS OF INTERNAL COMBUSTION ENGINE

(75) Inventor: Atsushi Yamanaka, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 75 days.

(21) Appl. No.: 11/350,756

(22) Filed: Feb. 10, 2006

(65) Prior Publication Data

US 2006/0231052 A1 Oct. 19, 2006

(30) Foreign Application Priority Data

Apr. 19, 2005 (JP) ..... 2005-120467

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,502,537 B2 * 1/2003 Todo et al. ..... 123/90.17
6,805,081 B2 10/2004 Watanabe et al.
7,100,556 B2 * 9/2006 Sugiura ..... 123/90.17

FOREIGN PATENT DOCUMENTS

JP 2004-11537 1/2004

* cited by examiner

*Primary Examiner*—Ching Chang
(74) *Attorney, Agent, or Firm*—Foley & Lardner LLP

(57) ABSTRACT

A variable valve timing control apparatus of an internal combustion engine includes a drive rotary member, a driven rotary member, and a phase-change mechanism disposed between the drive and driven rotary members. The phase-change mechanism changes a relative phase between the drive and driven rotary members by an operating force, and returns the relative phase to an engine start-up phase suitable for the engine start-up at the engine starting. The phase-change mechanism has a phase-change characteristic that a phase-change rate reduces near the engine start-up phase when the relative phase is returned to the engine start-up phase.

25 Claims, 7 Drawing Sheets

VARIABLE VALVE TIMING CONTROL APPARATUS OF INTERNAL COMBUSTION ENGINE

BACKGROUND OF THE INVENTION

The present invention relates to a variable valve timing control apparatus of an internal combustion engine, which variably controls open and closing timing of an intake valve and/or an exhaust valve of the engine according to an engine operating condition.

In recent years, there have been proposed and developed various variable valve timing control apparatuses. One such variable valve timing control apparatus has been disclosed in Japanese Patent Provisional Publication No. 2004-11537 (hereinafter is referred to as "JP2004-11537") corresponding to U.S. Pat. No. 6,805,081 (B2), applied for by this applicant.

The variable valve timing control apparatus disclosed in JP2004-11537 includes a timing sprocket to which torque is transferred from a crankshaft of an engine, a camshaft rotatably supported within a predetermined angular range with respect to the timing sprocket, a sleeve fixedly connected to the camshaft, and a rotational phase control mechanism (or a relative angular phase control mechanism) provided between the timing sprocket and the sleeve so as to control a rotational phase of the camshaft relative to the timing sprocket in accordance with an engine operation condition.

The rotational phase control mechanism includes a radial guide groove formed in the timing sprocket, a spiral guide (a concentric-spiral guide groove) formed on a surface of a spiral guide disk, a link member having two ends: an inner end pivotally fixed to the sleeve and an outer end slidably supported in the radial guide groove so that the outer end can slide in a radial direction along the radial guide groove, an engagement portion provided at the outer end of the link member, the engagement portion has a spherical portion (a semi-spherical protrusion) engaged with the spiral guide, and a hysteresis brake applying a braking force to the spiral guide disk according to an engine operating condition.

The hysteresis brake has at the front end side of the sleeve a coil yoke, and an electromagnetic coil circumferentially surrounded with the coil yoke. The coil yoke has at a rear side thereof a pair of circumferentially-opposed cylindrical surfaces with a cylindrical air gap left between the opposed surfaces. The coil yoke further has a plurality of pole teeth on the opposed surfaces respectively. Furthermore, a bottomed and cylindrical-shaped hysteresis member, which has a hysteresis characteristic of magnetic flux, is arranged in the air gap between the opposed surfaces (in the air gap between the opposed pole teeth). The hysteresis member is movable relative to the opposed pole teeth.

When the electromagnetic coil is energized, a magnetic field is induced between the opposed pole teeth across the hysteresis member, and thereby an electromagnetic brake acts on the spiral guide disk via the hysteresis member. By way of this action (braking on the spiral guide disk), the engagement portion is guided along the spiral guide while the engagement portion moves in the radial direction along the radial guide groove. Thus, the sleeve (also the camshaft) can be rotated relative to the timing sprocket within a predetermined angular range.

SUMMARY OF THE INVENTION

However, in the above-mentioned variable valve timing control apparatus in JP2004-11537, a reduction ratio (or a rate of reduction) of a spiral radius of the spiral guide is entirely constant. That is, the spiral guide is formed to gradually reduce its spiral radius with constant ratio along a direction of rotation of the timing sprocket. (This can be said that a rate of change of a relative rotational angle between the camshaft and the timing sprocket with respect to the rotational angle of the spiral guide disk is constant.) As a result of this spiral guide's shape, during the engine start-up in which the rotational phase control mechanism has not yet been acted on, the variable valve timing control apparatus can not stably hold an adjusted rotational phase (an adjusted rotational angle) between the timing sprocket and the sleeve owing to an unintentional torque occurred at the spiral guide disk, which results from a disturbing force such as an alternate torque of the camshaft caused by a valve spring force etc. Therefore, the relative rotational phase between the timing sprocket and the sleeve is changed, thereby there is a possibility that deterioration in the engine start ability will arise.

It is therefore an object of the present invention to provide a variable valve timing control apparatus of an internal combustion engine, which improves the engine start ability without failing to hold the rotational phase of an engine camshaft relative to an engine crankshaft.

According to one aspect of the present invention, a variable valve timing control apparatus comprises a drive rotary member adapted to be driven in synchronization with rotation of an engine crankshaft, a driven rotary member fixedly connected to a camshaft having a cam that actuates an engine valve, a phase-change mechanism capable of changing a relative phase between the drive and driven rotary members by an operating force, and configured to return the relative phase to a start-up phase, at which the engine is start able, under a specified condition where there is no application of the operating force, and the phase-change mechanism has a phase-change characteristic that, when returning the relative phase to the start-up phase, a phase-change rate reduces near the start-up phase.

According to another aspect of the invention, a variable valve timing control apparatus comprises a drive rotary member adapted to be driven in synchronization with rotation of an engine crankshaft, a driven rotary member fixedly connected to a camshaft having a cam that actuates an engine valve, a phase-change mechanism capable of changing a relative phase between the drive and driven rotary members by an operating force, and configured to return the relative phase to a start-up phase, at which the engine is start able, under a specified condition where there is no application of the operating force, and the phase-change mechanism has a phase-change characteristic that, even when the operating force is applied near the start-up phase, the start-up phase is fixed to a substantially constant phase.

According to a further aspect of the invention, a variable valve timing control apparatus comprises a drive rotary member adapted to be driven in synchronization with rotation of an engine crankshaft, a driven rotary member fixedly connected to a camshaft having a cam that actuates an engine valve, a phase-change mechanism comprising an intermediate rotary member disposed between the drive and driven rotary members and rotatable relative to the drive rotary member, and a speed reducer reducing relative rotation of the intermediate rotary member to the drive rotary member and transmitting the reduced relative rotation to the driven rotary member, for changing a relative phase between the drive and driven rotary members, the phase-change mechanism is configured to return the relative phase to a start-up phase, at which the engine is startable, under a specified condition where there is no operating-force applications and the phase-change mechanism has a phase-change characteristic that a speed-reduction ratio of the speed reducer increases near the start-up phase.

According to a still further aspect of the invention, a variable valve timing control apparatus comprises a drive rotary member adapted to be driven in synchronization with rotation of an engine crankshaft, a driven rotary member fixedly connected to a camshaft having a cam that actuates an engine valve, a phase-change mechanism comprising an intermediate rotary member disposed between the drive and driven rotary members and rotatable relative to the drive rotary member and having a clammed portion, and a movable member slidable relative to the intermediate rotary member while being in clammed-engagement with the clammed portion of the intermediate rotary member, for changing a relative phase between the drive and driven rotary members, the phase-change mechanism is configured to return the relative phase to a start-up phase, at which the engine is startable, under a specified condition where there is no operating-force application, and the clammed portion of the intermediate rotary member is formed to maintain the relative phase within a range of the start-up phase, even when a movement of the movable member occurs owing to application of the operating force, arising from a disturbance.

According to a still further aspect of the invention, a variable valve timing control apparatus comprises a drive rotary member adapted to be driven in synchronization with rotation of an engine crankshaft, a driven rotary member fixedly connected to a camshaft having a cam that actuates an engine valve, a phase-change mechanism comprising a movable member disposed between the drive and driven rotary members for changing a relative phase between the drive and driven rotary members by moving the movable member by an operating force, and a portion defining an inflexion point at which a direction of change of the relative phase is inverted as the movable member moves and passes through the inflexion point, the movable member of the phase-change mechanism is adapted to move with a small displacement with respect to the operating force near a start-up phase, at which the engine is startable, and a rate of change in the relative phase near the start-up phase is set to decrease in the same direction of change of the relative phase, by virtue of the movable member moving with the small displacement near the start-up phase.

According to a still further aspect of the invention, a variable valve timing control apparatus comprises a drive rotary member adapted to be driven in synchronization with rotation of an engine crankshaft, a driven rotary member fixedly connected to a camshaft having a cam that actuates an engine valve, a phase-change mechanism comprising a movable member disposed between the drive and driven rotary members for changing a relative phase between the drive and driven rotary members by moving the movable member by an operating force, and a portion defining an inflexion point at which a direction of change of the relative phase is inverted as the movable member moves and passes through the inflexion point, the movable member of the phase-change mechanism is adapted to move with a small displacement with respect to the operating force near a start-up phase, at which the engine is startable, and the direction of change of the relative phase is further inverted and additionally a rate of change in the relative phase with respect to the operating force near the start-up phase being set to decrease, by virtue of the movable member moving with the small displacement near the start-up phase.

According to a still further aspect of the invention, a variable valve timing control apparatus comprises a drive rotary member adapted to be driven in synchronization with rotation of an engine crankshaft, a driven rotary member fixedly connected to a camshaft having a cam that actuates an engine valve, a phase-change mechanism comprising a movable member disposed between the drive and driven rotary members for changing a relative phase between the drive and driven rotary members by moving the movable member by an operating force, and a portion defining an inflexion point at which a direction of change of the relative phase is inverted as the movable member moves and passes through the inflexion point, the movable member of the phase-change mechanism is adapted to move with a small displacement with respect to the operating force near a start-up phase, at which the engine is startable, and a rate of change in the relative phase near the start-up phase is retained substantially unchanged, by virtue of the movable member moving with the small displacement near the start-up phase.

The other objects and features of this invention will become understood from the following description with reference to the accompanying drawings.

DETAILED DESCRIPTION OF THE INVENTION

Figure 1:
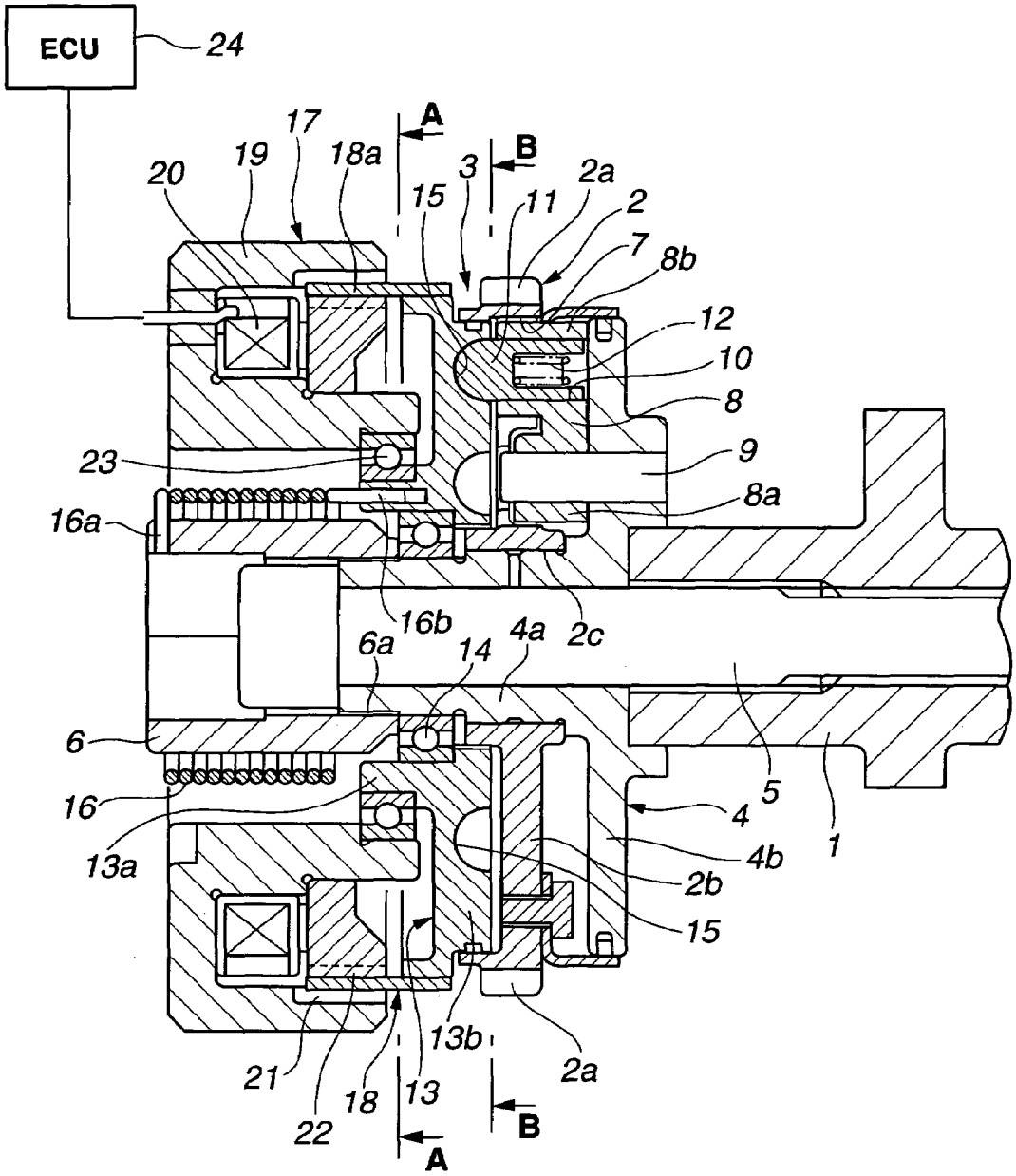
FIG. 1 is a longitudinal cross section showing a first variable valve timing control apparatus according to a first embodiment of the present invention.

The present invention will be explained below with reference to the drawings. In the following description, the terms "front" and "rear" are used for purposes of locating one element relative to another and are not to be construed as limiting terms. Further, although each of the variable valve timing control apparatus of the embodiments below is applied to control of open and closing timing of an intake valve for an internal combustion engine, it can also be applied to control of open and closing timing of an exhaust valve.

Firstly, a first embodiment of the present invention will be explained with reference to FIGS. 1 to 7. A variable valve timing control apparatus of the first embodiment includes a camshaft 1 rotatably supported on a cylinder head (not shown), a timing sprocket 2 (as a drive rotary member) rotatably disposed at front side of camshaft 1, and a relative angular phase control mechanism (simply, a phase converter or a phase-change mechanism) 3 disposed inside of timing sprocket 2 so as to control a relative rotational phase (or simply, a relative phase) between camshaft 1 and timing sprocket 2.

Camshaft 1 has two cams 1*a*, 1*a* for each cylinder which are disposed on an outer peripheral surface of camshaft 1 to actuate respective intake valves, a driven rotary member 4 fitted onto a front end of camshaft 1 by a cam bolt 5 so that driven rotary member 4 and camshaft 1 are coaxially aligned with each other, and a sleeve 6 which screws on and is fixed to a front end portion of driven rotary member 4.

Driven rotary member 4 has a cylindrical-shaped axis portion 4*a* and a large-diameter stepped flange portion 4*b*. Axis portion 4*a* is provided with a hole for receiving therethrough cam bolt 5. And further, axis portion 4*a* is formed with a male screw thread on an outer peripheral surface thereof at a front end portion thereof in order for sleeve 6 to screw on. Flange portion 4*b* is integrally formed with axis portion 4*a* at a rear end portion of axis portion 4*a* (at a position axially corresponding to the front end of camshaft 1).

Sleeve 6 is formed with a female screw thread 6*a* on an inner peripheral surface thereof at a rear end portion thereof in order for axis portion 4*a* to be screwed in. Moreover, sleeve 6 is caulked by an annular caulker so as to prevent sleeve 6 turning after sleeve 6 screws onto axis portion 4*a* fully and tightly and is fixed to axis portion 4*a*.

Regarding timing sprocket 2, a plurality of sprocket teeth 2*a* are integrally formed with an outer circumference of timing sprocket 2 in the circumferential direction. And then, timing sprocket 2 with this ring-shaped sprocket teeth 2*a* is linked to an engine crankshaft (not shown) and turns via a timing chain (not shown). Further, timing sprocket 2 has a plate member 2*b*, which is substantially disciform in shape, inside of sprocket teeth 2*a*. Plate member 2*b* is provided with a hole 2*c* at a center thereof for receiving therethrough axis portion 4*a* of driven rotary member 4. More specifically, an inner peripheral surface of hole 2*c* is supported on an outer peripheral surface of axis portion 4*a*. That is, timing sprocket 2 is rotatably supported on axis portion 4*a* of driven rotary member 4.

In addition, plate member 2*b* is provided with two radial guide grooves 7, 7 (as a radial guide) having parallel-opposed side walls respectively. More specifically, each of the radial guide grooves 7, 7 is formed through plate member 2*b* (that is, radial guide grooves penetrate plate member 2*b*) such that each of the radial guide grooves 7, 7 is arranged in a direction of a diameter of timing sprocket 2. Further, two guide grooves 2*d*, 2*d* are provided in plate member 2*b* between radial guide grooves 7, 7 respectively (two guide grooves 2*d*, 2*d* also penetrate plate member 2*b*). These radial guide groove 7 and guide groove 2*d* are provided for receiving therethrough a top end portion 8*b* (described later) and a lower end portion 8*a* (also described later) of a link member 8 (also described later), and thereby top end portion 8*b* and lower end portion 8*a* can move or slide along radial guide groove 7 and guide groove 2*d* respectively.

Each of the guide grooves 2*d*, 2*d* is formed into arc-shape along a circumferential direction radially outside of hole 2*c*. And, a length of guide groove 2*d* in the circumferential direction is set or dimensioned to a length corresponding to a range that lower end portion 8*a* moves (in other words, a length corresponding to a phase-shift range of relative rotational phase between camshaft 1 and timing sprocket 2).

Each of the two link members 8, 8 (as a movable member) is formed into arc-shape, and has two ends: lower end portion 8*a* and top end portion 8*b* at a front side of flange portion 4*b* of driven rotary member 4. Lower end portion 8*a* and top end portion 8*b* are both formed into cylindrical-shape, and protrude toward plate member 2*b* respectively. On the other hand, at a rear side of flange portion 4*b* (at the side of camshaft 1), two lever protrusions 4*p*, 4*p*, which radially protrude, are formed. And further, each hole 4*h* is provided at each lever protrusion 4*p* through each lever protrusion 4*p* and flange portion 4*b*. Lower end portion 8*a* is supported and rotatably or pivotally fixed to driven rotary member 4 by pin 9. And, one end portion of pin 9 is press-fitted in the above hole 4*h*.

As mentioned above, top end portion 8*b* of link member 8 is slidably engaged in radial guide groove 7. Top end portion 8*b* is formed with a retaining hole 10 opening toward the front direction. And further, an engaging pin 11 (as an engaged portion) having a spherical-shaped end at front end thereof and a coil spring 12 biasing engaging pin 11 toward the front direction are provided in retaining hole 10. Spherical-shaped end of engaging pin 11 is slidably engaged in a spiral guide groove 15 (described later) of a spiral guide disk 13 (also described later), and thereby top end portion 8*b* moves or slides in and along radial guide groove 7 while being guided along spiral guide groove 15.

More specifically, top end portion 8*b* is slidably engaged with radial guide groove 7, and lower end portion 8*a* is rotatably fixed to driven rotary member 4 by pin 9. In this setting, when top end portion 8*b* moves or slides in and along radial guide groove 7 by an external force which results from engaging pin 11 guided by spiral guide groove 15, lower end portion 8*a* moves or slides in and along guide groove 2*d*. Driven rotary member 4 consequently rotates relative to timing sprocket 2 in a circumferential direction corresponding to a direction in which top end portion 8*b* radially slides along radial guide groove 7 by degree corresponding to a displacement of top end portion 8*b*.

As for spiral guide disk 13 facing to a front side of plate member 2*b*, spiral guide disk 13 includes a cylindrical portion 13*a* having a ball bearing 14 and a disk portion 13*b* integrally formed with cylindrical portion 13*a* at rear end of cylindrical portion 13*a*. And then, spiral guide disk 13 is rotatably supported on axis portion 4*a* of driven rotary member 4 by way of ball bearing 14. Each of the two spiral guide grooves 15, 15 is formed on a rear surface of spiral guide disk 13 (that is, at the side of camshaft 1). Spiral guide groove 15 serving as a spiral guide is semi-circular in cross section. Spherical-shaped end 11*a* of engaging pin 11 of link member 8 is slidably engaged with spiral guide groove 15, and thereby being guided along spiral guide groove 15.

Spiral guide disk 13 is formed by way of high density sintered process (high density sintered process after pressure forming of powder metal molded into an intermediate rotary member and preliminary sintering (preliminary sintering process), the preliminarily sintered compact of intermediate rotary member is pressurized at high pressure (repressing process)). Accordingly, spiral guide groove 15 is formed simultaneously when forming sintered alloy or sintered metal of spiral guide disk 13 by the high density sintered process, and then the intermediate rotary member is formed.

Figure 5:
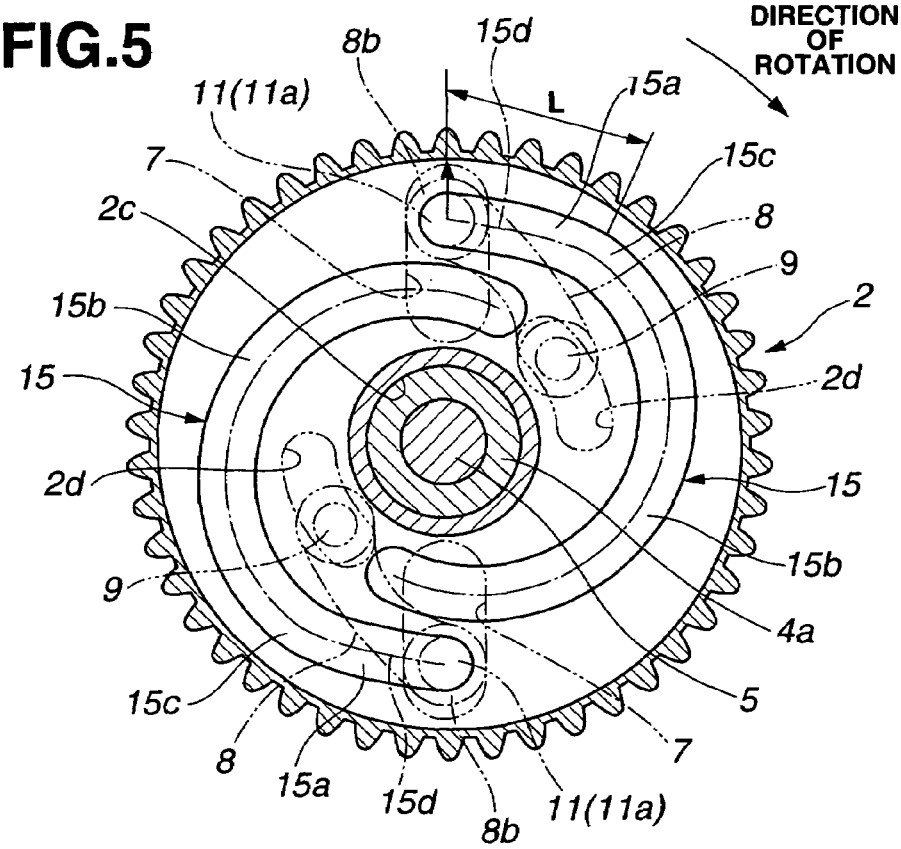
FIG. 5 is a sectional view of the first variable valve timing control apparatus, when taken along a line B-B of FIG. 1, during the engine startup.
Figure 6:
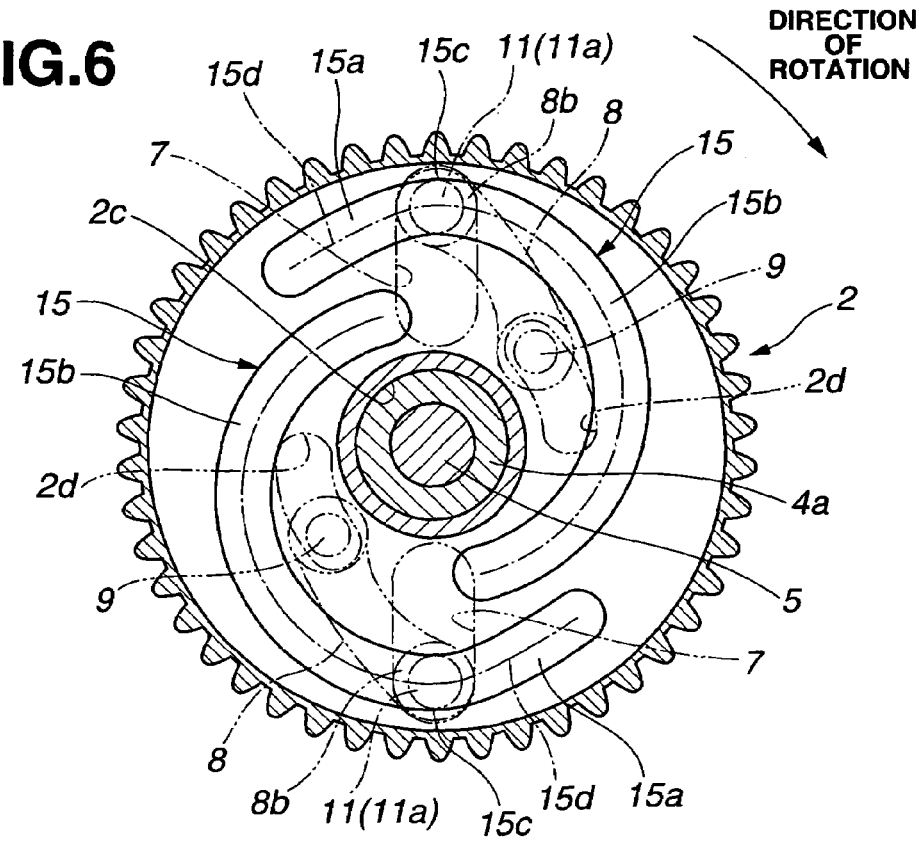
FIG. 6 is a sectional view of the first variable valve timing control apparatus, when taken along a line B-B of FIG. 1, under the condition that the rotational phase between drive and driven rotary members is shifted to a most-retarded phase position.
Figure 7:
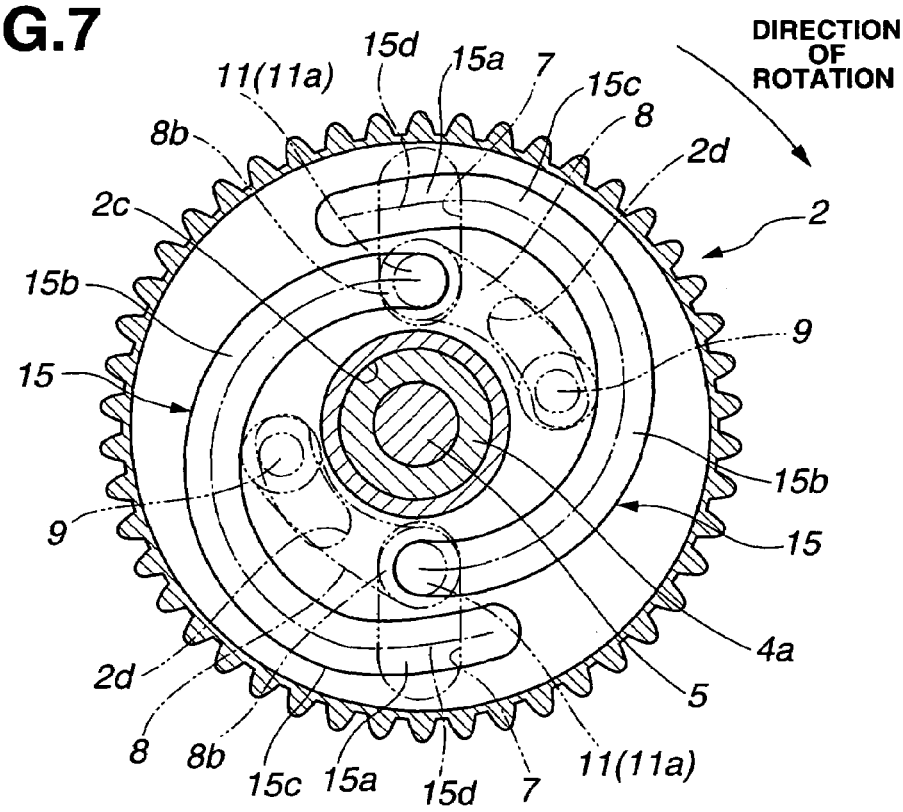
FIG. 7 is a sectional view of the first variable valve timing control apparatus, when taken along a line B-B of FIG. 1, under the condition that the rotational phase between drive and driven rotary members is shifted to a most-advanced phase position.

As can be seen from FIGS. 5 to 7, each of the spiral guide grooves 15, 15 is arranged separately each other. And further, each spiral guide groove 15 is formed such that its spiral radius gradually reduces along a direction of rotation of timing sprocket 2. More specifically, an outermost groove section 15*a* (that is, from an inflexion point 15*c* up to the top end) located at the outermost portion of spiral guide groove 15 is formed to be bent at the inflexion point 15*c* at a given angle. Furthermore, a top end portion of outermost groove section 15*a*, (that is, from a bending point 15*d* up to the top end) is formed to be inwardly slightly bent further by a small angle. The above bending point 15*d* is located at a substantially central portion of longitudinal length of outermost groove section 15*a*. As regards placement of outermost groove section 15*a*, it is preferable that it is formed within an angular range from 3° to 15° angle.

That is to say, spiral guide groove 15 has two sections: outermost groove section 15*a* and a normal section 15*b* except outermost groove section 15*a*. Outermost groove section 15*a* corresponds to one spiral-guide end section of both ends of the spiral guide groove 15. A rate of change of the relative rotational phase between camshaft 1 and timing sprocket 2 obtained during engaging pin 11 (also top end portion 8*b* of link member 8) guided along normal section 15*b* is constant. That is, a spiral radius of normal section 15*b* gradually reduces with constant ratio along the direction of rotation of timing sprocket 2. On the other hand, a convergence rate or a convergence constant of outermost groove section 15*a* substantially corresponding to a rate of change of a spiral radius of outermost groove section 15*a* is small as compared with that of normal section 15*b*. And moreover, outermost groove section 15*a* is set to be in a substantially straight line along a tangent line of spiral guide disk 13, and a length L of outermost groove section 15*a* is set to be relatively long. Further, as mentioned above, a top end portion from the bending point 15*d* up to the top end is formed to be inwardly slightly bent further by a very small is angle. Bending point 15*d* is located at the substantially central portion of the longitudinal length L of outermost groove section 15*a* as described above as well.

Figure 8:
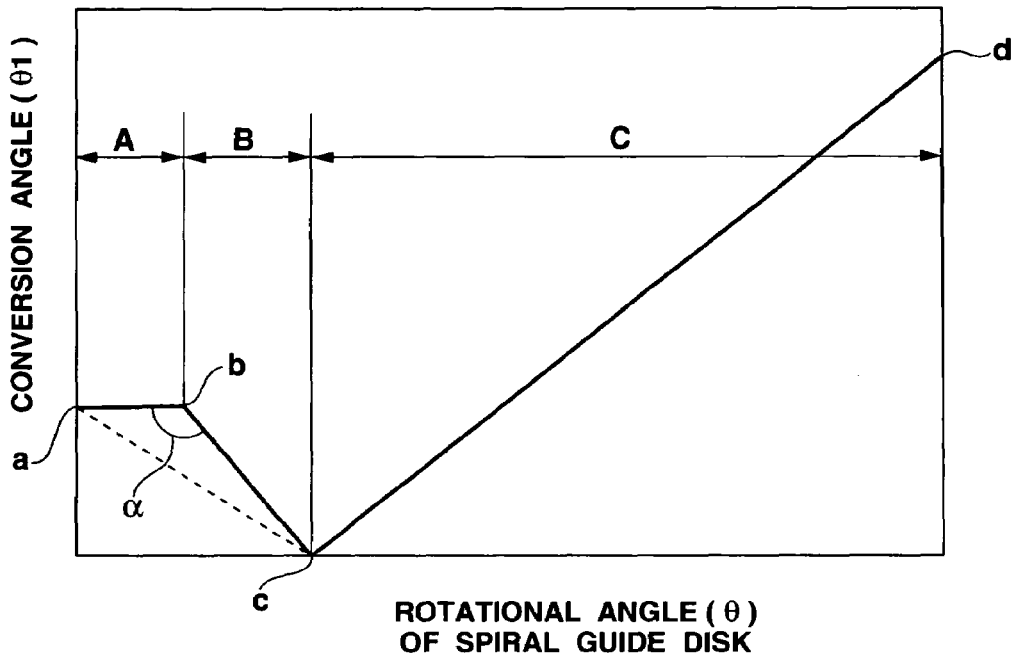
FIG. 8 is a characteristics showing a control margin in a relationship between a rotational angle of the spiral guide disk and a conversion angle (a relative rotational phase-shift angle).

In this spiral guide groove 15, as spiral guide disk 13 rotates, engaging pin 11 radially moves along radial guide groove 7 while being guided by spiral guide groove 15. When moving, a rate of displacement of engaging pin 11 moving longitudinally along radial guide groove 7 varies depending on sections of spiral guide groove 15 where engaging pin 11 is guided. In other words, as shown in FIG. 8, a relative rotational phase-shift angle θ1 (or a conversion angle θ1) between camshaft 1 and timing sprocket 2 varies according to a rotational angle θ of spiral guide disk 13. In more detail, a speed-reduction ratio of the conversion angle θ1 with respect to the rotational angle θ of spiral guide disk 13 differs between outermost groove section 15*a* and normal section 15*b* by way of a speed reducer, which comprises the above spiral guide disk 13, spiral guide groove 15, link member 8, engaging pin 11 and others. A speed-reduction ratio of outermost groove section 15*a*, which is associated with a shape thereof, is set to be greater than or equal to 6 (at least, θ:θ1=6:1), conversely, a speed-reduction ratio of normal section 15*b* is constant.

When spiral guide disk 13 relatively rotates in a retarding direction with respect to timing sprocket 2 with engaging pin 11 which is engaged with spiral guide groove 15, top end portion 8*b* of link member 8 moves in a radially inward direction in and along radial guide groove 7 while being guided by spiral guide groove 15. At this time, camshaft 1 is rotated in an advancing direction. FIG. 7 shows a state of a rotational phase between camshaft 1 and timing sprocket 2, shifted to a most-advanced phase position. On the other hand, when spiral guide disk 13 relatively rotates in an advancing direction with respect to timing sprocket 2, top end portion 8*b* moves in a radially outward direction. Here, when engaging pin 11 (also top end portion 8*b*) comes to inflexion point 15*c* while being guided, camshaft 1 is most retarded. FIG. 6 shows a state of a rotational phase between camshaft 1 and timing sprocket 2, shifted to a most-retarded phase position.

And further, when spiral guide disk 13 rotates further, engaging pin 11 (also top end portion 8*b*) is guided and positioned at outermost groove section 15*a*. At this time, a phase of camshaft 1 is slightly shifted from the above most-retarded phase position (FIG. 6) to an advanced phase position suitable for an engine starting (simply, an engine start-up phase).

The above-mentioned spiral guide disk 13 is provided with an operating turning force by way of a control force or operating force application mechanism (described later). When provided with the operating turning force, top end portion 8*b* of link member 8 is radially displaced in and along radial guide groove 7 by the operating force via spherical-shaped end 11*a* of engaging pin 11 guided by spiral guide groove 15. At this time, by way of motion-conversion action of link member 8, driven rotary member 4 is displaced in the direction of rotation thereof or is relatively rotated with respect to timing sprocket 2 by the turning force. That is, link member 8 slidably engaged in radial guide groove 7 and spiral guide groove 15 serves to convert the radial displacement of top end portion 8*b* along radial guide groove 7 into the displacement of lower end portion 8*a* in the circumferential direction along guide groove 2*d*. In other words, link member 8 rockably linked to both of the radial guide groove 7 and the spiral guide groove 15 acts as a motion converter, and thereby driven rotary member 4 is rotated.

As shown in FIG. 1, the operating force application mechanism includes a torsion spring 16 (as a biasing device, i.e. as a means for forcing) permanently forcing spiral guide disk 13 in the direction of rotation of timing sprocket 2 via sleeve 6, a hysteresis brake 17 (an electromagnetic brake) that selectively generates a braking force against a force of torsion spring 16 to force spiral guide disk 13 in the reverse direction to the rotation of timing sprocket 2, and an controller 24 (ECU: electrical control unit) that allows hysteresis brake 17 to adjust its braking force as appropriate according to the engine operating condition, and thereby relatively turning spiral guide disk 13 with respect to timing sprocket 2, and also controlling and holding or maintaining a relative rotational position between them.

As can be seen from FIG. 1, torsion spring 16 is disposed outside of sleeve 6. And a first end portion 16*a* of torsion spring 16 is radially inserted into a hole formed at a front end portion of sleeve 6 and is fixed to sleeve 6. On the other hand, a second end portion 16*b* of torsion spring 16 is inserted into a hole formed at a front side of cylindrical portion 13*a* in an axial direction and is fixed to cylindrical portion 13*a*. The torsion spring 16 serves to force and turn spiral guide disk 13 in a direction of a starting rotational phase after the engine has stopped.

Regarding hysteresis brake 17, hysteresis brake 17 includes a hysteresis ring 18 integrally connected and fixed to a front outer periphery of spiral guide disk 13, an annular coil yoke 19 arranged at a front side of hysteresis ring 18, and an electromagnetic coil 20 circumferentially surrounded with coil yoke 19 to induce magnetic flux in coil yoke 19. The controller 24 precisely controls applying current to electromagnetic coil 20 according to the engine operating condition, and thus a relatively large magnetic flux is generated.

Hysteresis ring 18 is made of a magnetically semi-hardened material (i.e. a hysteresis material) having a characteristic showing a change of magnetic flux with phase lag behind a change of external magnetic field. A top end portion 18*a* of hysteresis ring 18 is disposed such that top end portion 18*a* is in a cylindrical air gap between circumferentially-opposed pole teeth 21, 22 (described later) formed on inner and outer peripheral surfaces of coil yoke 19 apart from the opposed pole teeth. Therefore, coil yoke 19 has a braking action on hysteresis ring 18.

Coil yoke 19 is formed into a substantially cylindrical outwardly, such that coil yoke 19 circumferentially surrounds electromagnetic coil 20. Further, coil yoke 19 is held unrotatably by an engine cover (not shown) through a rattle or lash-absorption mechanism (or a lash eliminator). And also, coil yoke 19 is supported on cylindrical portion 13*a* of spiral guide disk 13 via a ball bearing 23 provided at a cylindrical inner surface of coil yoke 19 such that spiral guide disk 13 rotates relative to coil yoke 19.

Figure 2:
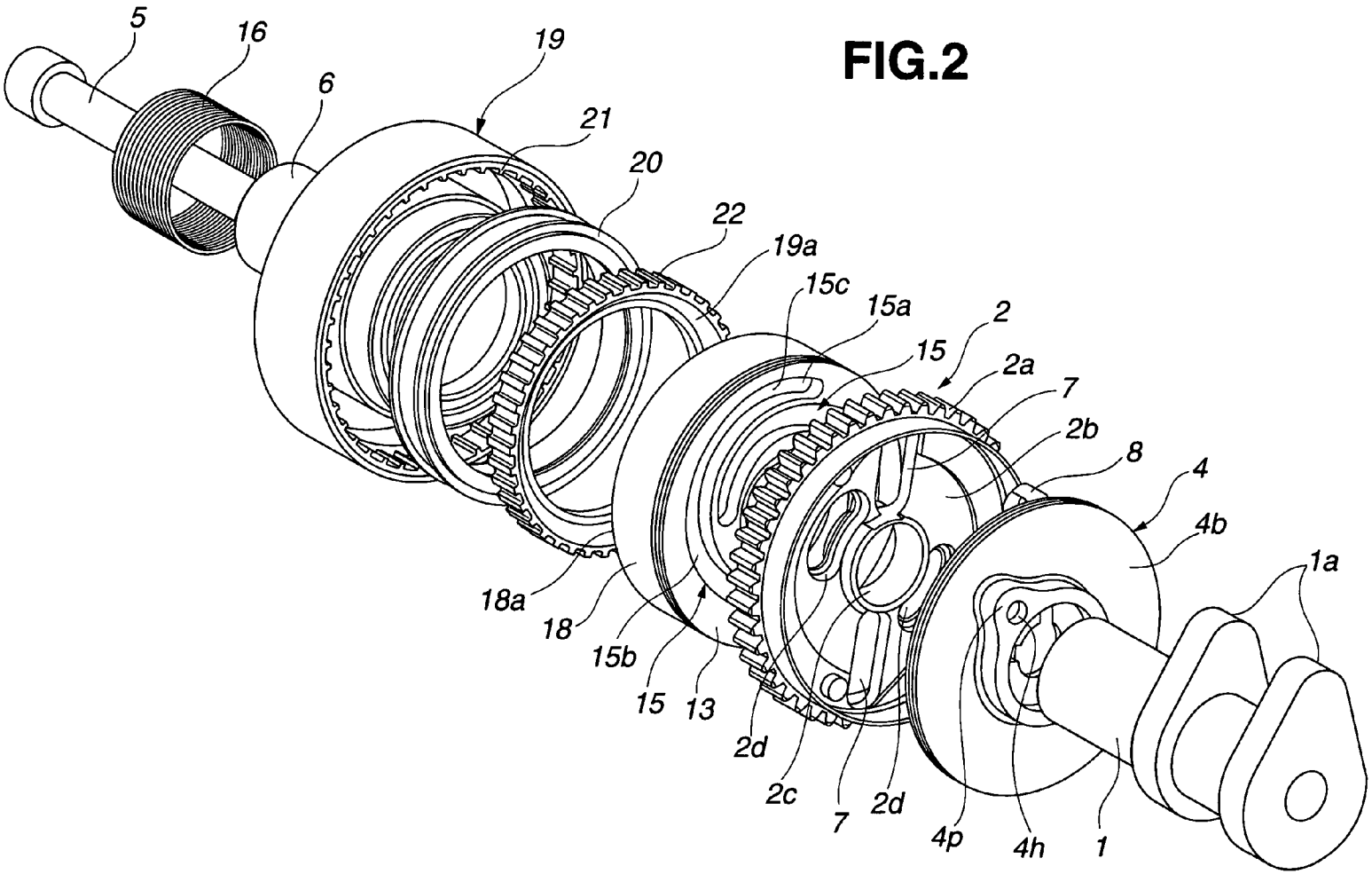
FIG. 2 is a perspective exploded view of the first variable valve timing control apparatus, when viewed from a direction of the rear side.
Figure 3:
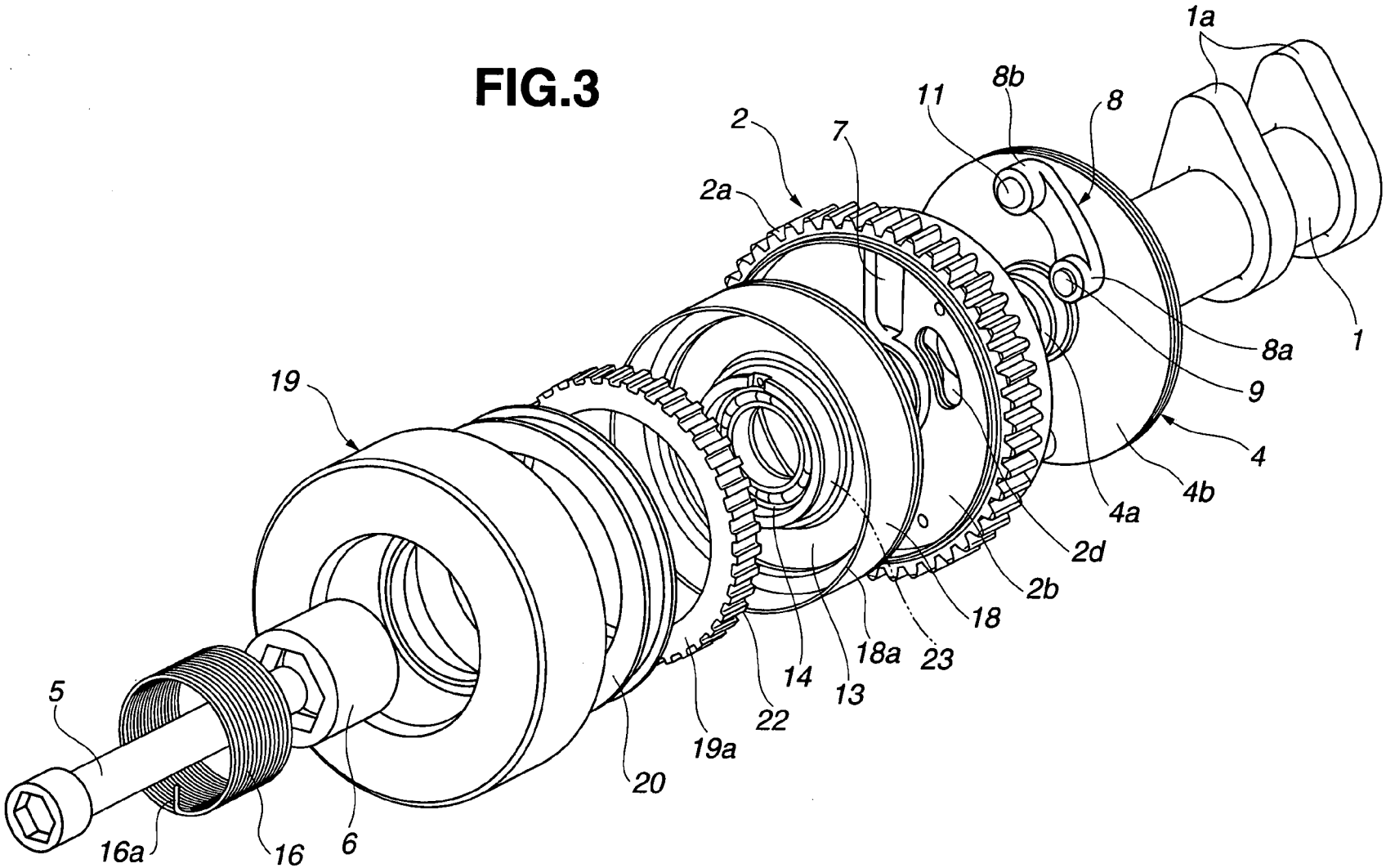
FIG. 3 is a perspective exploded view of the first variable valve timing control apparatus, when viewed from a direction of the front side.
Figure 4:
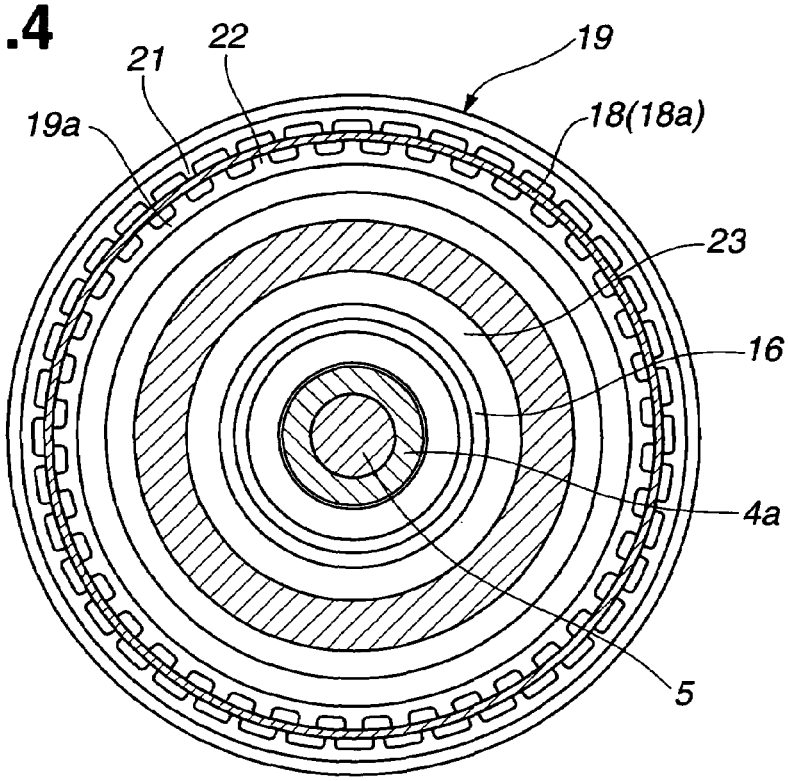
FIG. 4 is a sectional view of the first variable valve timing control apparatus, when taken along a line A-A of FIG. 1.

As explained in detail about pole teeth 21, 22, as can be seen from FIGS. 2 to 4, coil yoke 19 includes a ring yoke portion 19*a* in an interior space portion thereof at a rear side thereof, and a plurality of the opposed pole teeth 21, 22 are arranged circumferentially at regular intervals on inner peripheral surface of the interior space portion of coil yoke 19 and outer peripheral surface of ring yoke portion 19*a*. More specifically, each of the pole teeth 21, 22 formed in projected shape and serving to generate magnetic field (as a magnetic field generating portion) is arranged circumferentially in a staggered configuration. That is, each recessed portion between each tooth of pole teeth 21, 22 and each projected portion of pole teeth 21, 22 is placed on opposite sides of the circumferential air gap. Upon energization by electromagnetic coil 20, magnetic field is generated between the opposed adjacent projected portions. In other words, a direction of the generated magnetic field is at an angle relative to a circumferential direction of hysteresis ring 18. As described above, top end portion 18*a* of hysteresis ring 18 is located in the cylindrical air gap between circumferentially-opposed pole teeth 21, 22. More specifically, an air gap between an outer peripheral surface of top end portion 18*a* and pole teeth 21, and an air gap between an inner peripheral surface of top end portion 18*a* and pole teeth 22 are set to infinitesimally small distances respectively to obtain a large magnetic force.

When electromagnetic coil 20 induces magnetic flux in coil yoke 19 and hysteresis ring 18 rotates and is displaced in the magnetic field between opposed pole teeth 21, 22, the braking force is generated due to a difference between a direction of magnetic flux in hysteresis ring 18 and a direction of the magnetic field, and thereby hysteresis brake 17 acts to brake hysteresis ring 18 or to stop the rotation of hysteresis ring 18. A strength of the braking force is independent of a rotational speed of hysteresis ring 18 (i.e. a relative speed between hysteresis ring 18 and opposed pole teeth 21, 22), but is substantially proportional to an intensity of the magnetic field (i.e. an amount of magnetizing current supplied to electromagnetic coil 20). That is, if the amount of magnetizing current supplied to electromagnetic coil 20 is constant, the strength of the braking force is also constant.

The controller 24 detects a current engine operating condition based on input information from a crank angle sensor detecting an engine speed, an airflow meter detecting an intake-air quantity and an engine load, an accelerator opening sensor, an engine temperature sensor and others (these are not shown), and then outputs a signal of control current supplied to electromagnetic coil 20 according to the engine operating condition.

The relative angular phase control mechanism 3 has the radial guide groove 7 of the timing sprocket 2, the link member 8, the engaging pin 11, the lever protrusion 4*p*, the spiral guide disk 13, the spiral guide groove 15, the operating force application mechanism and others. In addition, an oil-supplying passage (not shown) communicated with a main oil gallery (not shown) is provided in the inside of camshaft 1 and so on, in order to supply and circulate the oil (lubricating oil) to an engine valve system. And thus, this avoids a change of electrical resistance of electromagnetic coil 20 caused by a temperature change (especially, change to high temperature) of electromagnetic coil 20 due to a braking operation by hysteresis brake 17, and thereby the strength of the braking force can be kept at a constant strength. Further, this can enhance lubricity of sliding portions such as spiral guide groove 15 and engaging pin 11.

Next, an operation of relative angular phase control mechanism 3 and the operating force application mechanism of first embodiment will be explained in detail. When electromagnetic coil 20 of hysteresis brake 17 is de-energized in an engine halt state, spiral guide disk 13 is rotated fully in a direction of rotation of the engine with respect to timing sprocket 2 by way of the force of torsion spring 16. At this time, as shown in FIG. 5, spherical-shaped end 11*a* of engaging pin 11 is shifted and positioned at the top end portion of outermost groove section 15*a* of spiral guide groove 15, and thereby the rotational phase of camshaft 1 relative to the engine crankshaft is shifted to the engine start-up phase, which is a slightly advanced phase position as compared with the most-retarded phase position, and is maintained at this position. That is to say, engine valve open and closure timings at the engine start-up are set to suitable timings for the engine start-up.

In addition to this, when turning an ignition on for the engine starting, there is a possibility that spiral guide disk 13 will be unintentionally rotated owing to occurrence or generation of a disturbing force such as an alternate torque or positive and/or negative torque fluctuations. In more detail, the positive and/or negative torque fluctuations occur during the engine starting, and are transferred to spiral guide disk 13. And thus, there is a risk that spiral guide disk 13 may be unintentionally rotated against the force of torsion spring 16. However, as described above, engaging pin 11 is kept or maintained at outermost groove section 15*a* with stability, and thereby the rotational phase of camshaft 1 relative to the engine crankshaft is maintained at the phase position suitable for the engine starting. Accordingly, this can enhance engine startability.

Furthermore, there may be cases where the above mentioned oil supplied to the relative angular phase control mechanism 3 is trapped in an infinitesimal gap between hysteresis ring 18 and opposed pole teeth 21, 22 in the engine halt state. In this case, a braking force which results from viscous drag of the oil acts on hysteresis ring 18, and thereby there is a possibility that spiral guide disk 13 will be unintentionally relatively rotated in the advancing direction during the engine starting. This causes the instability of rotational phase of camshaft 1 for the engine starting. However, as mentioned above, outermost groove section 15*a* of spiral guide groove 15 is bent inwardly, and the speed-reduction ratio thereof is set to be greater than or equal to 6. Consequently, an operating or working resistance of engaging pin 11 positioned at outermost groove section 15*a* against outermost groove section 15*a* becomes great, and thereby holding spiral guide disk 13 stably. It is therefore possible to avoid the unintentional rotation of spiral guide disk 13 and to maitain the rotational phase of camshaft 1 with stability at the engine start-up. Accordingly, this can enhance engine startability. In addition to this, as timing sprocket 2 drives driven rotary member 4 through the relative angular phase control mechanism at the engine start-up, there occurs a force (a reaction force) acting on driven rotary member 4 (also link member 8 and engaging pin 11) in a direction that retards the rotation of driven rotary member 4 by a friction generated between timing sprocket 2 and driven rotary member 4. And the reaction force hinders engaging pin 11 from maintaining at outermost groove section 15*a*, and a backlash may occur in a engagement between engaging pin 11 and outermost groove section 15*a*. However, by way of the above outermost groove section 15*a*, it is possible to suppress the backlash and an unusual noise caused by the backlash.

After the engine starts, during the engine operating at low-rpm such as idling conditions, when the control current is supplied to electromagnetic coil 20 by the controller 24, the magnetic force generated at hysteresis brake 17 acts as braking force against the force of torsion spring 16 on spiral guide disk 13. Regarding the control current, the strength of the braking force is substantially proportional to the amount of the control current supplied to electromagnetic coil 20, as mentioned above. Thus, the control current is set to a relatively larger control current than normal such that guided engaging pin 11 slightly rapidly moves toward the inflexion point 15*c* in spiral guide groove 15. As explained in more detail about this, as can be seen from FIG. 6, as this control current is supplied and the braking force acts on spiral guide disk 13, spiral guide disk 13 relatively rotates in the reverse direction to the rotation of timing sprocket 2. Meanwhile, timing sprocket 2 keeps turning while engaging top end portion 8*b* (also engaging pin 11 guided by spiral guide groove 15) in radial guide groove 7. Engaging pin 11 therefore moves toward the inflexion point 15*c* in spiral guide groove 15 rapidly, and also top end portion 8*b* moves in the radially outward direction in and along radial guide groove 7 by the above supplied control current. Thus, a rotational phase of driven rotary member 4 relative to timing sprocket 2 is shifted toward the most-retarded phase position via the motion-conversion action of link member 8. As a result, a rotational phase of camshaft 1 relative to the engine crankshaft (i.e. a rotational phase between camshaft 1 and the engine crankshaft) is shifted toward the most-retarded phase position suitable for low-rpm conditions. This can improve not only the stability of rotation of the engine but also fuel economy at the idling condition.

After this condition, during the engine operating at high-rpm such as normal driving conditions, in order for the above rotational phase to shift toward the most-advanced phase position, another control current (larger than the current at low-rpm condition) is supplied to electromagnetic coil 20 by the controller 24. When hysteresis ring 18 of spiral guide disk 13 receives the braking force by the above control current, spiral guide disk 13 relatively rotates further in the reverse direction to the rotation of timing sprocket 2. And thereby, as can be seen from FIG. 7, engaging pin 11 is guided by spiral guide groove 15 and moves toward an innermost portion of normal section 15*b*, and also top end portion 8*b* moves in the radially inward direction in and along radial guide groove 7. Thus, a rotational phase of driven rotary member 4 relative to timing sprocket 2 is shifted toward the most-advanced phase position via the motion-conversion action of link member 8. As a result, the rotational phase of camshaft 1 relative to the engine crankshaft is shifted toward the most-advanced phase position. This can bring about a high power generation of the engine.

FIG. 8 shows a relationship between the conversion angle θ1 adjusted from low-rpm to high-rpm condition and the rotational angle θ of spiral guide disk 13. Wherein, the conversion angle θ1 indicates the relative rotational phase-shift angle of camshaft 1 with respect to the engine crankshaft. FIG. 8 also shows a control margin from the top end portion of outermost groove section 15*a* to the innermost portion of normal section 15*b*. That is, during the early stage of engine start-up, the conversion angle θ1 varies little (in other words, substantially constant) with the rotational angle θ in a slightly advanced phase region a-b (simply, A-region) corresponding to a region from top end portion of outermost groove section 15*a* to bending point 15*d*. Conversely, at the idling condition, the conversion angle θ1 changes abruptly toward the most-retarded angle with a change of the rotational angle θ in a region b-c (simply, B-region) corresponding to a region from bending point 15*d* to inflexion point 15*c*. Further, the conversion angle θ1 adjusted during a condition from the normal driving to high-rpm condition varies linearly gradually with the rotational angle θ from the most-retarded angle toward the most-advanced angle in a region c-d (simply, C-region) corresponding to a region from inflexion point 15*c* to the innermost portion of normal section 15*b*. In addition, as can be seen from FIG. 8, a characteristic of the conversion angle θ1, i.e. a direction of change of the conversion angle θ1 is inverted at the position corresponding to inflexion point 15*c*.

Accordingly, in the first embodiment, by the provision of the specific-shaped outermost groove section 15*a* of spiral guide groove 15, that is, by the setting of the outermost groove section 15*a* having the small phase-change rate (great speed-reduction ratio), an advanced phase region a-c (A and B-regions) corresponding to a phase range suitable for the engine start-up can be formed, and thereby the working resistance of engaging pin 11 against the advanced phase region a-c becomes great. And thus, engaging pin 11 can be maintained at outermost groove section 15*a* corresponding to an advanced phase region a-c (A and B-regions) with stability at the engine start-up. More specifically, the outermost groove section 15*a* is dimensioned to be relatively long. Moreover, the slightly advanced phase region a-b (A-region) is set so that the conversion angle θ1 is substantially fixed within the A-region with respect to the rotational angle θ of spiral guide disk 13. Therefore, even when spiral guide disk 13 receives the unintentional torque resulting from the disturbing force and thereby engaging pin 11 receives a force making engaging pin 11 move in a radially outward direction (indicated by arrow of FIG. 5) in the outermost groove section 15*a*, an movement of engaging pin 11 by the above force is blocked by an outer edge of outermost groove section 15*a*. As a result, a retaining force between engaging pin 11 and outermost groove section 15*a* is improved at the engine start-up. Consequently, it is possible to prevent the unintentional rotation of spiral guide disk 13 caused by the disturbing force. In addition to this, even if a backlash caused by alternate torque or positive and/or negative torque fluctuations should arise and be transferred to link member 8 or spiral guide disk 13 should be unintentionally rotated at the engine start-up, although top end portion 8*b* of link member 8 may slide relative to outermost groove section 15*a*, top end portion 8*b* does not move relative to radial guide groove 7 due to outermost groove section 15*a* formed at substantially same radius from a rotation center of spiral guide groove 15. Accordingly, the relative rotational phase between camshaft 1 and timing sprocket 2 is hold, and thereby enhancing engine startability.

Further, after the engine start-up, spiral guide disk 13 can be relatively rapidly rotated in the reverse direction to the rotation of timing sprocket 2 by way of enhanced braking force by increasing the control current supplied to electromagnetic coil 20. Moreover, when rotated, engaging pin 11 can be guided by spiral guide groove 15 in one direction without repeatedly moving at the position between outermost groove section 15*a* and normal section 15*b* due to the shape of outermost groove section 15*a*, i.e. the inflexion point 15*c*. As a result, it is possible to prevent deterioration in responsiveness of not only control for valve timing adjusted toward the most-retarded position after the engine start-up but also control for valve timing adjusted toward the most-advanced position from the most-retarded position.

In addition, in the relative angular phase control mechanism 3 of the first embodiment, hysteresis brake 17 is provided as a braking system. It is therefore possible to obtain a greater braking force acting on spiral guide disk 13 by way of an increase of control current supplied to electromagnetic coil 20. And further, it is easily efficiently possible to prevent deterioration in responsiveness of the shift of rotational phase from the engine start-up to the normal driving conditions by way of increasing control current.

Regarding the spiral guide groove 15, the shape of normal section 15*b* can be set to a proper desired shape except for outermost groove section 15*a*. This allows a desired engine control without affecting an engine control for the engine start-up.

And further, regarding two radial guide grooves 7, 7, two link members 8, 8, two spiral guide grooves 15, 15 and others, these are respectively arranged to be circumferentially symmetrical to each other about an axis of camshaft 1 as can be seen from FIGS. 2, 3 and 5-7. Because of this arrangement, a load on link member 8 can be distributed between two link members 8, 8, and thereby reducing surface pressure acting between each link member 8 and each spiral guide groove 15. Furthermore, although an alternate load radially acts on spiral guide groove 15 via engaging pin 11 by the positive and/or negative torque fluctuations generated at driven rotary member 4, the alternate load is distributed between two spiral guide grooves 15, 15. And also, shake or vibration of spiral guide groove 15 caused by the distributed alternate load is canceled due to the shaking in the balanced direction. Accordingly, this can efficiently reduce or attenuate the shake or the vibration resulting from the positive and/or negative torque fluctuations.

Regarding spiral guide disk 13, this is formed by way of high density sintered process. And thus, the complex shaped spiral guide groove 15 is accurately formed when forming spiral guide disk 13 at the same time. Further, it is possible to avoid damage or the wearing out of spiral guide disk 13 and spiral guide groove 15 by the using thereof for years, and thereby increasing durability thereof.

Next, a second embodiment of the present invention will be explained with reference to FIG. 9. A variable valve timing control apparatus of the second embodiment is structurally similar to that of the first embodiment, except for a shape of outermost groove section 15*a* of spiral guide groove 15. The shape of outermost groove section 15*a* can be set to obtain a desired characteristic for the engine start-up by changing an angle of bend (or flexion angle) of the bending point 15*d*.

Figure 9:
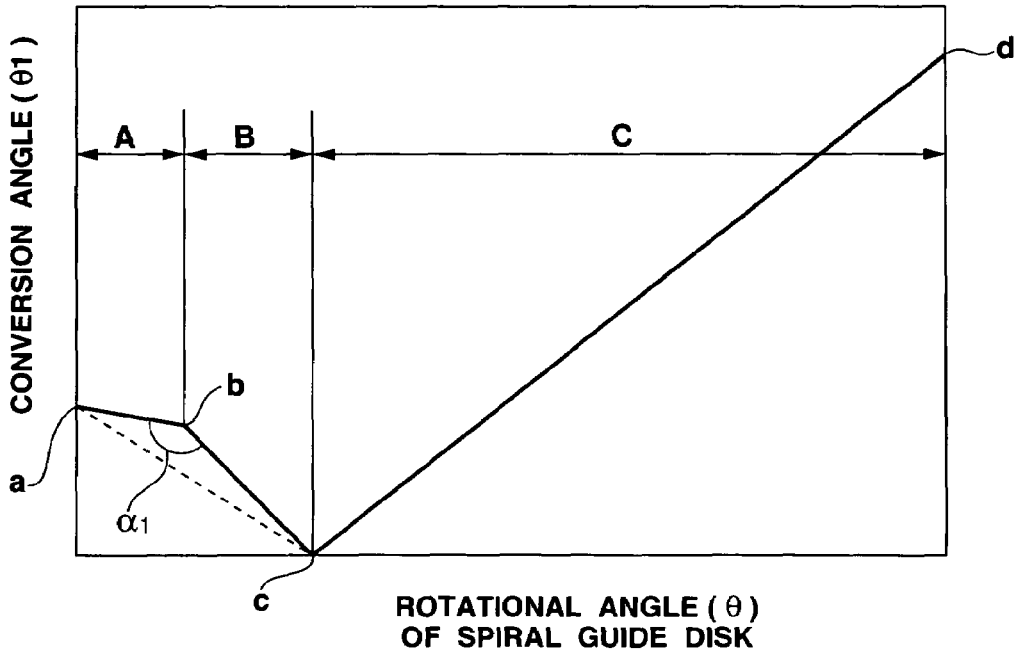
FIG. 9 is a characteristics showing a control margin in a relationship between a rotational angle of the spiral guide disk and a conversion angle (a relative rotational phase-shift angle) according to a second embodiment.

As shown in FIG. 9, a flexion angle $\alpha 1$ of the bending point 15*d* is dimensioned to be slightly greater than a flexion angle $\alpha$ of the first embodiment. That is, a speed-reduction ratio of outermost groove section 15*a* is set to be less than 6. In this case, the unintentional rotation of spiral guide disk 13 by the disturbing force during the engine start-up can be inhibited by way of the setting of the above outermost groove section 15*a* as a matter of course. Further, a rate of change in the relative phase (namely, the conversion angle $\theta 1$) in the A-region is set to decrease same as that in the B-region. That is, both of the directions of change of the relative phase in the A-region and in the B-region are set to the same direction with respect to the rotational angle $\theta$. Consequently, this allows spiral guide disk 13 to rotate smoothly up to a position corresponding to the most-retarded position after the engine start-up, and thereby improving operational responsiveness.

Figure 10:
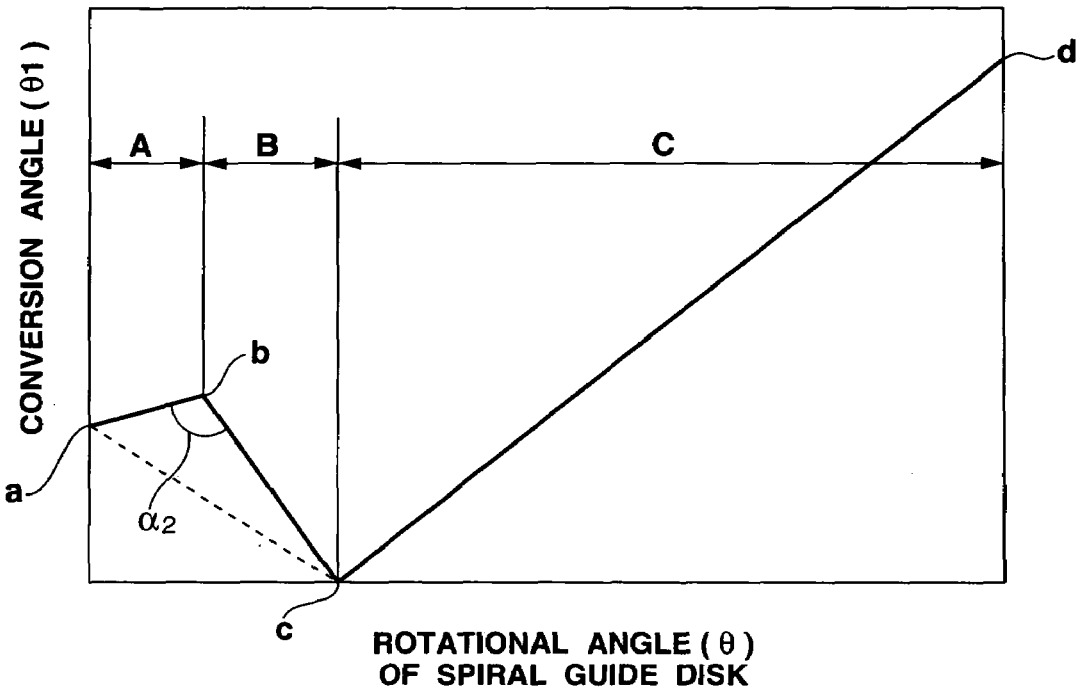
FIG. 10 is a characteristics showing a control margin in a relationship between a rotational angle of the spiral guide disk and a conversion angle (a relative rotational phase-shift angle) according to a third embodiment.

A third embodiment of the present invention will be explained with reference to FIG. 10. A variable valve timing control apparatus of the third embodiment is also structurally similar to that of the first embodiment, except for the shape of outermost groove section 15*a* of spiral guide groove 15. As can be seen from FIG. 10, a flexion angle $\alpha 2$ of the bending point 15*d* is dimensioned to be slightly smaller than the flexion angle $\alpha$ of the first embodiment. A speed-reduction ratio of outermost groove section 15*a* is set to be greater than 6. In this case, a rate of change in the relative phase (namely, the conversion angle $\theta 1$) in the A-region is set to slightly increase in contrast to that in the B-region. That is, each of the directions of change of the relative phase in the A-region and in the B-region changes or is inverted at the point "b" corresponding to the bending point 15*d*. Consequently, the unintentional rotation of spiral guide disk 13 caused by the disturbance during the engine start-up can be certainly inhibited by way of the above setting of the outermost groove section 15*a*.

With regard to the relative rotational phase between camshaft 1 and the engine crankshaft according to the variable valve timing control apparatus of the present invention, the relative rotational phase can be set to any rotational phase by changing the control current supplied to electromagnetic coil 20 (that is, by controlling the braking force of hysteresis brake 17) according to the engine operating condition besides the above-mentioned the most-retarded and the most-advanced phase position. For instance, it is possible to maintain and adjust the rotational phase to a position corresponding to substantially half of 50° crank angle by adjusting the balance between the force of torsion spring 16 and the braking force of hysteresis brake 17.

The variable valve timing control apparatus of the above embodiments can produce advantageous effects as described above. However, structure or shape of the embodiments is not limited, these can be modified. For example, a pulley driven by a timing belt made of rubber or elastic may be used as a means for transferring driving force other than the sprocket. Further, a member driven by the mesh of gearwheels can also be used.

Moreover, instead of using the spiral guide disk with the spiral guide groove in the relative angular phase control mechanism, for instance, the use of a cam with a cam groove or a clammed portion is possible. The cam is formed with the cam groove, and a piston, hydraulically or electromagnetically actuated and moves in the axial direction, is formed with a protrusion at the top thereof. The protrusion slides along the cam groove, and thus the relative rotational phase of the camshaft is adjusted in the same manner as the above mentioned embodiments. In this case as well, the relative rotational phase is changed depending on a shape of the cam groove. Further, a planetary gear is possible instead of using the cam. In addition, the relative angular phase control mechanism can be applied to a helical gear-type relative angular phase control mechanism without using the electromagnetic brake.

As a means for forcing spiral guide disk to turn in one direction, the following means can be possible instead of using the torsion spring. That is, the convergence rate of the spiral guide groove is set such that the spiral guide disk turns toward a rotational position suitable for the engine start-up by using torque differentials between the positive and negative torque fluctuations generated at camshaft as a power source.

As a means for supporting or holding the engaged portion instead of the radial guide groove, a guiding projection to slidably hold and guide the engaged portion can be used. The guiding projection can be arranged not only continuously but discontinuously. Further, the radial guide groove and the guiding projection can be arranged to be not only linearly but also curvilinearly. Furthermore, these may also be arranged on the tilt. However, these modified examples have to be set such that these extend from center of rotation to radially outward direction.

In the above embodiments, the spiral guide groove having a bottom is used. However, a spiral guide groove without a bottom, that is, spiral guide groove that penetrates the intermediate rotary member (the spiral guide disk 13) can be used. Moreover, the spiral guide groove may be formed by forming a protrusion. In addition, the movable member can be formed into any proper shape, and a roller or a ball can be provided at a top end portion of the movable member as a sliding member.

This application is based on a prior Japanese Patent Application No. 2005-120467 filed on Apr. 19, 2005. The entire contents of this Japanese Patent Application No. 2005-120467 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a drive rotary member adapted to be driven in synchronization with rotation of an engine crankshaft;

a driven rotary member fixedly connected to a camshaft having a cam that actuates an engine valve;

a phase-change mechanism capable of changing a relative phase between the drive and driven rotary members by an operating force, and configured to return the relative phase to a start-up phase, at which the engine is startable, under a specified condition where there is no application of the operating force; and the phase-change mechanism having a phase-change characteristic that, when returning the relative phase to the start-up phase, a phase-change rate reduces near the start-up phase.

2. The variable valve timing control apparatus as claimed in claim 1, wherein: the phase-change mechanism comprises:

(a) a radial guide formed in either one of the drive and driven rotary members;

(b) an intermediate rotary member disposed between the drive and driven rotary members and rotatable relative to both of the drive and driven rotary members, and having a spiral guide formed in the intermediate rotary member;

(c) a movable member slidably engaged in both of the radial guide and the spiral guide;

(d) an operating force application mechanism which applies the operating force to the intermediate rotary member to produce rotary motion of the intermediate rotary member; and (e) a motion converter), which converts a movement of the movable member into a relative rotation of the driven rotary member with respect to the drive rotary member.

3. The variable valve timing control apparatus as claimed in claim 2, wherein:

the movable member shifts to one spiral-guide end section of both ends of the spiral guide under the specified condition where there is no application of the operating force to the intermediate rotary member by the operating force application mechanism, and a convergence rate of the spiral-guide end section is set to a relatively small rate as compared with the other spiral-guide section.

4. The variable valve timing control apparatus as claimed in claim 3, wherein:

the convergence rate of the spiral-guide end section is set to such a small rate that the relative phase is maintained within a range of the start-up phase when the operating force is applied to the intermediate rotary member owing to a disturbance.

5. The variable valve timing control apparatus as claimed in claim 3, wherein:

the spiral-guide end section is formed within a predetermined range along the locus at a substantially same radius from a rotation center of the spiral guide.

6. The variable valve timing control apparatus as claimed in claim 5, wherein:

the predetermined range within which the spiral-guide end section is formed along the locus at the substantially same radius from a rotation center of the intermediate rotary member identical to the rotation center of the spiral guide, is set to such an extended range that the movable member remains in the spiral-guide end section even when the intermediate rotary member rotates in a normal-rotational direction or in a reverse-rotational direction owing to a disturbance under the specified condition where there is no application of the operating force by the operating force application mechanism during engine start-up.

7. The variable valve timing control apparatus as claimed in claim 6, wherein:

the predetermined range is set within an angular range from 3 degrees to 15 degrees.

8. The variable valve timing control apparatus as claimed in claim 3, wherein:

the operating force application mechanism comprises a biasing device that rotatably forces the intermediate rotary member in a direction the movable member shifts to the spiral-guide end section.

9. The variable valve timing control apparatus as claimed in claim 2, wherein:

the spiral guide has an inflexion point, which is formed in one spiral-guide end section of both ends of the spiral guide and at which a radius from a rotation center of the spiral guide decreases, and wherein, when the movable member is positioned at the inflexion point, the relative phase is set to a substantially most-retarded phase position, and when the movable member shifts to a substantially midpoint of the spiral-guide end section, the relative phase is set to an intermediate phase position phase-advanced from the substantially most-retarded phase position.

10. The variable valve timing control apparatus as claimed in claim 9, wherein:

a movement of the movable member is controlled to be movable within a range from the inflexion point to another spiral-guide end section of the spiral guide, after the engine has started.

11. The variable valve timing control apparatus as claimed in claim 2, wherein:

the operating force application mechanism is electrically-operated.

12. The variable valve timing control apparatus as claimed in claim 11, wherein:

the operating force application mechanism comprises an electromagnetic brake.

13. The variable valve timing control apparatus as claimed in claim 2, wherein:

the motion converter comprises a linkage) radially spaced from a common rotation center of the drive and driven rotary members, and rockably linking the movable member to both of the radial guide and the spiral guide.

14. The variable valve timing control apparatus as claimed in claim 2, wherein:

either one of the drive and driven rotary members is formed with at least two radial guides, the intermediate rotary member is formed with at least two spiral guides, and at least two movable members are provided for slidably being engaged in each of the radial guides and spiral guides.

15. The variable valve timing control apparatus as claimed in claim 14, wherein:

each of the radial guides and spiral guides and movable members is respectively arranged to be circumferentially symmetrical to each other about an axis of the camshaft.

16. The variable valve timing control apparatus as claimed in claim 2, wherein:

the spiral guide comprises a spiral guide groove formed in the intermediate rotary member.

17. The variable valve timing control apparatus as claimed in claim 16, wherein:

the intermediate rotary member formed with the spiral guide groove is made of sintered alloy.

18. The variable valve timing control apparatus as claimed in claim 17, wherein:

the intermediate rotary member formed with the spiral guide groove is formed by way of a high density sintered process including the steps of (i) preliminarily sintering a powder metal molded into the intermediate rotary member to produce a preliminarily sintered compact of the intermediate rotary member; and (ii) recompressing the preliminarily sintered compact of the intermediate rotary member under high pressure.

19. A variable valve timing control apparatus of an internal combustion engine, comprising:

a drive rotary member adapted to be driven in synchronization with rotation of an engine crankshaft;

a driven rotary member fixedly connected to a camshaft having a cam that actuates an engine valve;

a phase-change mechanism capable of changing a relative phase between the drive and driven rotary members by an operating force, and configured to return the relative phase to a start-up phase, at which the engine is startable, under a specified condition where there is no application of the operating force; and the phase-change mechanism having a phase-change characteristic that, even when the operating force is applied near the start-up phase, the start-up phase is fixed to a substantially constant phase.

20. A variable valve timing control apparatus of an internal combustion engine, comprising:

a drive rotary member adapted to be driven in synchronization with rotation of an engine crankshaft;

a driven rotary member fixedly connected to a camshaft having a cam that actuates an engine valve;

a phase-change mechanism comprising an intermediate rotary member disposed between the drive and driven rotary members and rotatable relative to the drive rotary member, and a speed reducer reducing relative rotation of the intermediate rotary member to the drive rotary member and transmitting the reduced relative rotation to the driven rotary member, for changing a relative phase between the drive and driven rotary members;

the phase-change mechanism being configured to return the relative phase to a start-up phase, at which the engine is startable, under a specified condition where there is no operating-force application; and the phase-change mechanism having a phase-change characteristic that a speed-reduction ratio of the speed reducer increases near the start-up phase.

21. The variable valve timing control apparatus as claimed in claim 20, wherein:

the speed-reduction ratio of the speed reducer is set to be greater than or equal to 6 near the start-up phase.

22. A variable valve timing control apparatus of an internal combustion engine, comprising:

a drive rotary member adapted to be driven in synchronization with rotation of an engine crankshaft;

a driven rotary member fixedly connected to a camshaft having a cam that actuates an engine valve;

a phase-change mechanism comprising an intermediate rotary member disposed between the drive and driven rotary members and rotatable relative to the drive rotary member and having a cammed portion, and a movable member slidable relative to the intermediate rotary member while being in cammed-engagement with the cammed portion of the intermediate rotary member, for changing a relative phase between the drive and driven rotary members;

the phase-change mechanism being configured to return the relative phase to a start-up phase, at which the engine is startable, under a specified condition where there is no operating-force application; and the cammed portion of the intermediate rotary member being formed to maintain the relative phase within a range of the start-up phase, even when a movement of the movable member occurs owing to application of the operating force, arising from a disturbance.

23. A variable valve timing control apparatus of an internal combustion engine, comprising:

a drive rotary member adapted to be driven in synchronization with rotation of an engine crankshaft;

a driven rotary member fixedly connected to a camshaft having a cam that actuates an engine valve;

a phase-change mechanism comprising a movable member disposed between the drive and driven rotary members for changing a relative phase between the drive and driven rotary members by moving the movable member by an operating force, and a portion defining an inflexion point at which a direction of change of the relative phase is inverted as the movable member moves and passes through the inflexion point;

the movable member of the phase-change mechanism being adapted to move with a small displacement with respect to the operating force near a start-up phase, at which the engine is startable; and a rate of change in the relative phase near the start-up phase being set to decrease in the same direction of change of the relative phase, by virtue of the movable member moving with the small displacement near the start-up phase.

24. A variable valve timing control apparatus of an internal combustion engine, comprising:

a drive rotary member adapted to be driven in synchronization with rotation of an engine crankshaft;

a driven rotary member fixedly connected to a camshaft having a cam that actuates an engine valve;

a phase-change mechanism comprising a movable member disposed between the drive and driven rotary members for changing a relative phase between the drive and driven rotary members by moving the movable member by an operating force, and a portion defining an inflexion point at which a direction of change of the relative phase is inverted as the movable member moves and passes through the inflexion point;

the movable member of the phase-change mechanism being adapted to move with a small displacement with respect to the operating force near a start-up phase, at which the engine is startable; and the direction of change of the relative phase being further inverted and additionally a rate of change in the relative phase with respect to the operating force near the start-up phase being set to decrease, by virtue of the movable member moving with the small displacement near the start-up phase.

25. A variable valve timing control apparatus of an internal combustion engine, comprising:

a drive rotary member adapted to be driven in synchronization with rotation of an engine crankshaft;

a driven rotary member fixedly connected to a camshaft having a cam that actuates an engine valve;

a phase-change mechanism comprising a movable member disposed between the drive and driven rotary members for changing a relative phase between the drive and driven rotary members by moving the movable member by an operating force, and a portion defining an inflexion point at which a direction of change of the relative phase is inverted as the movable member moves and passes through the inflexion point;

the movable member of the phase-change mechanism being adapted to move with a small displacement with respect to the operating force near a start-up phase, at which the engine is startable; and a rate of change in the relative phase near the start-up phase being retained substantially unchanged, by virtue of the movable member moving with the small displacement near the start-up phase.

* * * * *